US007114189B1

(12) United States Patent
Kleinert

(10) Patent No.: US 7,114,189 B1
(45) Date of Patent: Oct. 3, 2006

(54) KNEE PROTECTOR

(75) Inventor: James M. Kleinert, Louisville, KY (US)

(73) Assignee: Hillerich & Bradsby Co., Louisville, KY (US)

( * ) Notice: Subject to any disclaimer, the term of this patent is extended or adjusted under 35 U.S.C. 154(b) by 0 days.

(21) Appl. No.: 10/955,719

(22) Filed: Sep. 30, 2004

(51) Int. Cl.
*A41D 13/00* (2006.01)

(52) U.S. Cl. ..... 2/24

(58) Field of Classification Search ..... 2/16, 2/22, 24, 242, 911, DIG. 3, 455, 23; 602/6, 602/26, 62, 63; 128/881, 882
See application file for complete search history.

(56) References Cited

U.S. PATENT DOCUMENTS

| | | | | |
|---|---|---|---|---|
| 1,525,298 A | | 3/1925 | Hartman | |
| 3,411,222 A | * | 11/1968 | Williams | 434/255 |
| 4,068,312 A | | 1/1978 | Ledesma | |
| 4,084,584 A | * | 4/1978 | Detty | 602/26 |
| 4,201,203 A | | 5/1980 | Applegate | |
| 4,250,578 A | * | 2/1981 | Barlow | 2/24 |
| 4,272,850 A | | 6/1981 | Rule | |
| 4,287,885 A | | 9/1981 | Applegate | |
| 5,168,576 A | | 12/1992 | Krent et al. | |
| D338,280 S | | 8/1993 | Krent et al. | |
| D360,284 S | | 7/1995 | Paffett et al. | |
| 5,477,558 A | | 12/1995 | Volker et al. | |
| 5,500,955 A | | 3/1996 | Gongea | |
| 6,223,350 B1 | * | 5/2001 | McFarlane | 2/24 |
| 6,279,160 B1 | * | 8/2001 | Chen | 2/24 |
| 6,519,781 B1 | * | 2/2003 | Berns | 2/267 |
| 6,584,616 B1 | | 7/2003 | Godshaw et al. | |
| 2003/0050586 A1 | | 3/2003 | Domanski et al. | |

FOREIGN PATENT DOCUMENTS

| | | |
|---|---|---|
| JP | 401171849 A | 7/1989 |
| JP | 02003020504 A | 1/2003 |

* cited by examiner

*Primary Examiner*—Tejash Patel
(74) *Attorney, Agent, or Firm*—Charles G. Lamb; Middleton Reutlinger

(57) ABSTRACT

A knee protector includes a plurality of pads positioned to cover a patella, a lower portion of the distal femur, the femoral condyles, the upper end of the fibula and an upper end of the proximal tibia with spacings between said pads to accommodate the flexion and extension of the knee when in use from a standing to a squatting position by a wearer.

17 Claims, 5 Drawing Sheets

KNEE PROTECTOR

BACKGROUND OF THE INVENTION

The present invention relates to a knee protector, particularly for use in athletic endeavors. More particularly, the present invention is directed to a knee protector which includes pads at selected areas surrounding the knee cap and are slidably disposed in use from a standing position to a bending condition.

Knee protectors are well known for use by athletes in participation of sports wherein the knee area of the athlete experiences contact with the ground or floor in which the athletic endeavor is occurring. There have been a number of devices proposed for the protection of the knee or the knee cap, but many of these devices either do not provide adequate protection for the knee or knee cap when it comes into contact with the ground or the floor or is extremely cumbersome to the wearer in moving from an upright or standing or moving condition to a bending condition, such as that of a catcher in baseball or softball or a goalie in hockey. For example, in many knee protectors or knee pads, rubbing movements produced between the cushioned or padded areas and the skin is produced upon the bending of the knee. This is due to the fact that the knee experiences an extension in front portion of the knee between the thigh on the one hand and the shin bone on the other. That is, the knee area is lengthened upon the bending of the knee and shortened upon an extension of the knee. The materials used for cushioning or padding generally have elastomeric properties, but the elasticity of the materials do not completely compensate for this extension in the knee area. Moreover, the continuous relative movements of the bending of the knee can cause the padding to slip into positions in which protection for the knee area is substantially reduced.

SUMMARY OF THE INVENTION

It is an object of the present invention to provide a protective layer of padding around the knee cap of a wearer in athletic endeavors.

Another object of the present invention is to provide padded protection for the knee cap area of a wearer which remains in place upon bending and extension or lengthening of the knee.

It is also an object of the present invention to provide a knee protector which has different thicknesses or layers of padding at selected areas around the knee cap to provide optimum protection for the knee cap upon bending and lengthening of the knee.

More particularly, the present invention is directed to a knee protector which includes a leg sleeve having an upper opening for receiving a distal femur and a lower opening for receiving a proximal tibia with a cut-out to accommodate a knee posterior. A plurality of pads are positioned within the sleeve at selected positions to cover a patella, a lower portion of the distal femur, the femoral condyles, an upper end of the fibula, and an upper end of the proximal tibia with spacings between the plurality of pads to accommodate bending and lengthening of a knee.

In a preferred knee pad or protector of the present invention, a more fully described knee protector is hereinafter described.

BRIEF DESCRIPTION OF THE DRAWINGS

Referring to the drawings.

DETAILED DESCRIPTION OF THE PREFERRED EMBODIMENTS

In the knee protector of the present invention, the knee protector is shown and described for use on the left leg of a user. It is realized that a right knee protector would be a symmetrical reproduction of the left knee.

Figure 1:
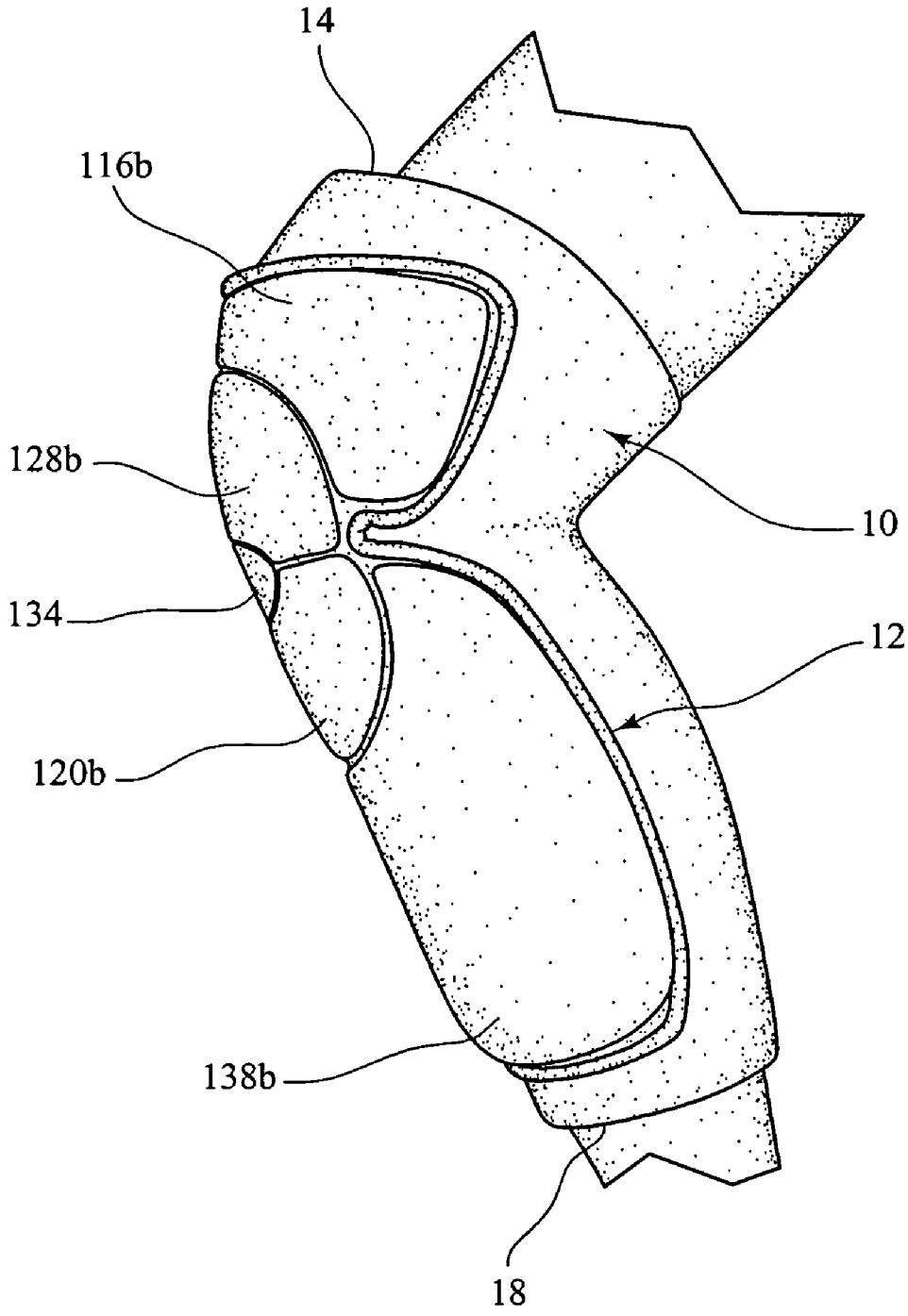
FIG. 1 shows a knee protector for a knee in accordance with the present invention as seen from the side in a bending condition.
Figure 1A:
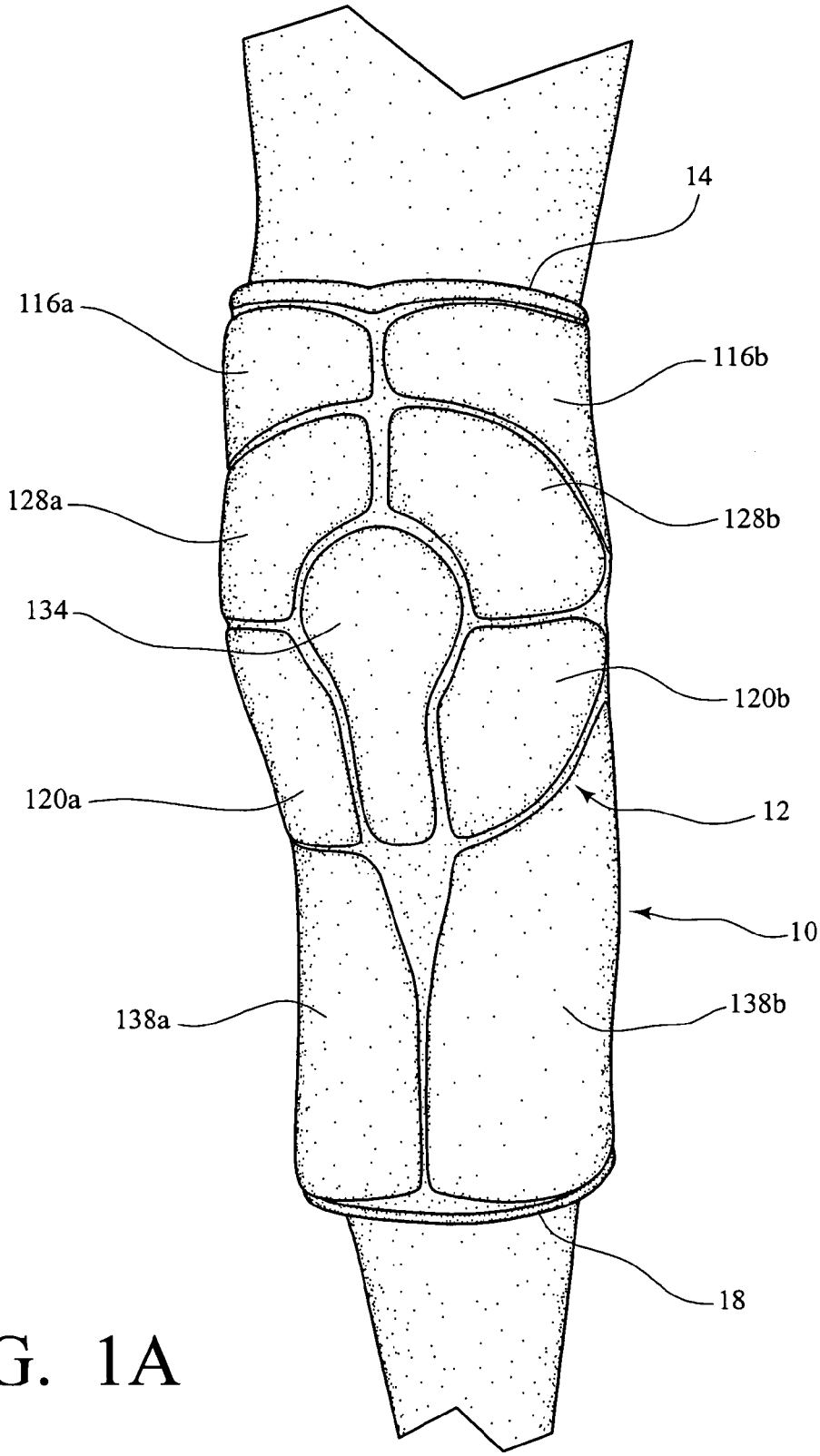
FIG. 1A shows the knee protector of FIG. 1 in a lengthened condition in a front view.

As shown in FIG. 1 and FIG. 1A, a knee protector 10 includes a sleeve 12 with a plurality of pads disposed at preselected areas along the outer surface of the sleeve 12. The sleeve 12 is provided with an upper opening 14 to receive the distal femur 16 (FIG. 4) of a leg and a lower opening 18 to receive the proximal tibia 20 (FIG. 4) therein. The padding to be discussed hereinafter may be attached to the inside or the outside of the sleeve 12 and may also include a separate covering (not shown) if desired. The sleeve 12 may include a slit along the backside, (not shown) with fastening and adjustment by any well known fastening devices. Alternatively, sleeve 12 may be an elastomeric material and sized to receive a distal femur 16 in the upper portion thereof and a proximal tibia 20 in the lower portion thereof (FIGS. 3, 4).

Figure 2:
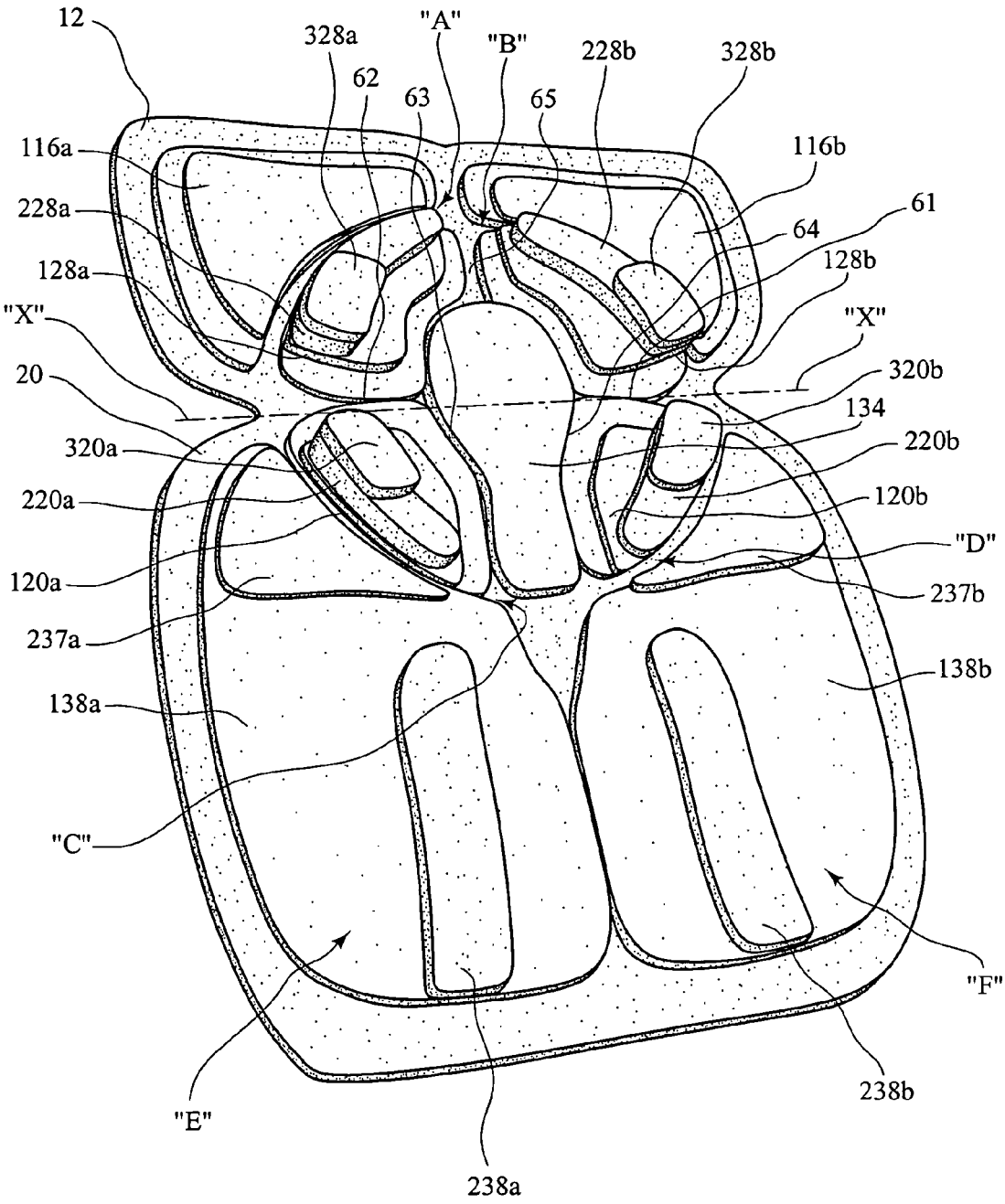
FIG. 2 is a perspective view of the padding as shown in FIG. 1 with the outer sleeve of the knee protector removed.
Figure 3:
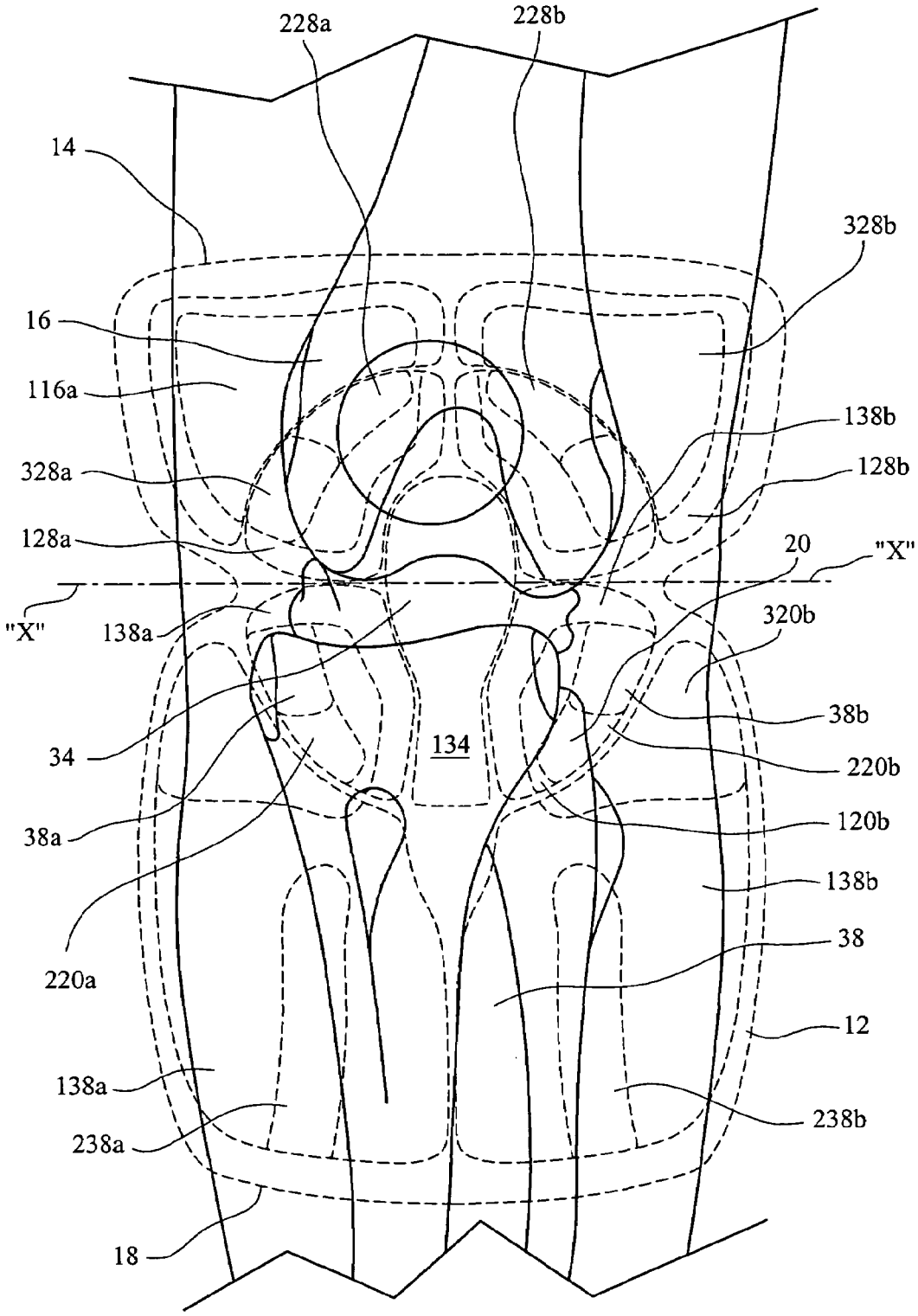
FIG. 3 shows the knee protector of FIG. 1 of the present invention in a front view with the knee extended and the bone parts of the left knee being shown in solid lines and the knee padding shown in phantom lines; and, FIG. 4 shows the knee pad of FIG. 1 of the present invention as seen in a side view with the knee extended and the bone parts of the knee shown in solid lines and the padding shown in phantom lines.
Figure 4:
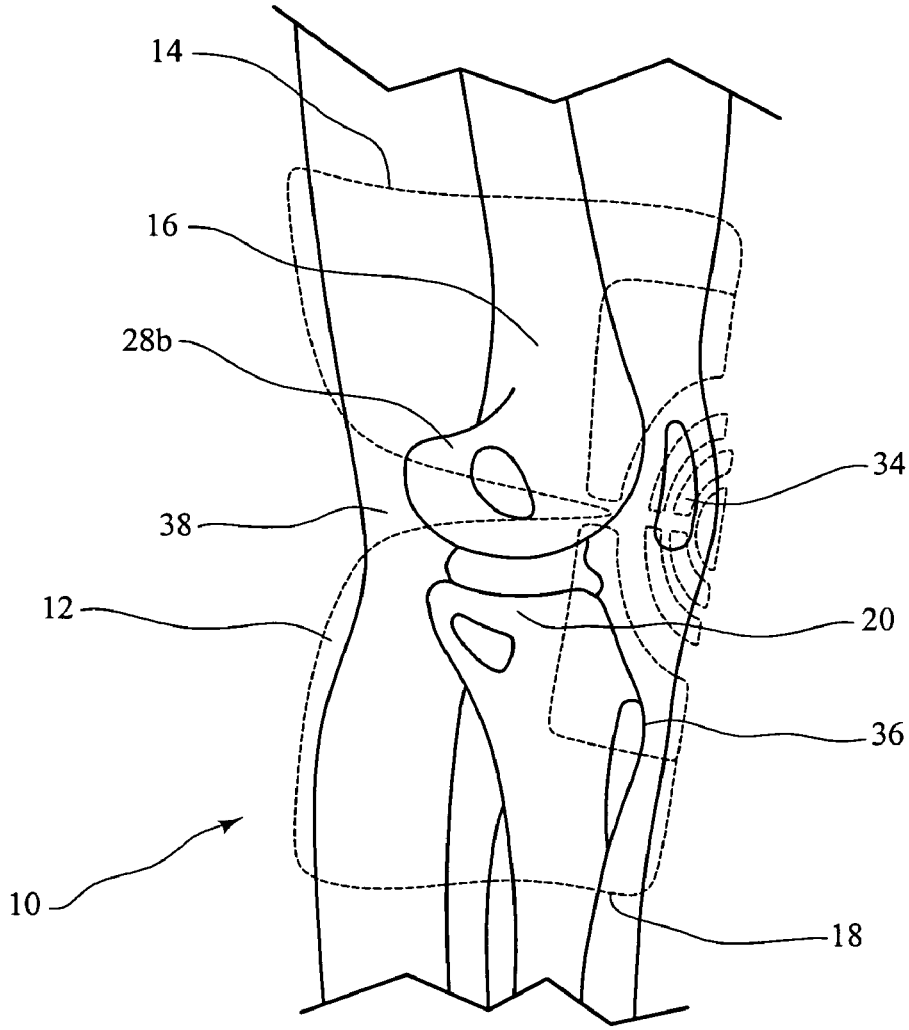

As best shown in FIG. 2, the padding of the instant invention is shown in four main sections identified as areas A, B, C and D over selected portions of the leg anatomy as shown in FIGS. 3 and 4. Section areas A and B including femoral condyle pads 128*a* and 128*b*, respectively, are positioned over the lower or distal end of the femur 16 and especially over the femoral condyles 28*a* and 28*b*. Sections C and D including proximal tebia padding 120*a* and 120*b*, respectively, are positioned over the upper (proximal) end of the tibia (shin bone) 38. A tear-drop shaped pad 134 is positioned over the knee cap 34 (patella) and the patella tendon and tibial tubercle 36 (FIG. 4). As best shown in FIG. 2, Section A is spaced from Section area B, as indicated by the numeral 65, and from Section area C, as indicated by the numeral 62, and the patella pad 134 by the numeral 63. Moreover, spacing 63 separates the patella pad 134 from section area pad C. Spacing 64 separates patella pad 134 from section area pad B and D and spacing 61 separates Section B from Section D. Thus, spacing 65 between padded areas A and B provides a longitudinal break in the knee protector 10 and the spacing 61 between padded areas B and D in cooperation with spacing 62 between padded areas A and C provide a transverse break in the knee protector 10. The longitudinal break along spacing 65 allows expansion of the knee protector 10 upon knee flexion and the transverse break along spacings 61, 62 allow unimpeded knee flexion and extension. Preferably, spacings 61, 62 are at the center axis of rotation of the knee joint.

It is noted that in a preferred embodiment, there are increasing number of layers around all four corners of the knee cap or patella 34. This increased padding helps direct impact away from the front of the knee and distributes the impact more evenly. These additional layers of padding provides additional protection over the front of the knee joint. As best shown in FIGS. 2 and 3 the layer of padding identified by the numerals 228*a* and 228*b* are over the femoral condyles 28*a* and 28*b* which includes the front of the knee joint and the layers 328*a* and 328*b* follow the contour of the bony anatomy of the femoral condyles 28*a* and 28*b* to provide additional protection for the femoral condyles on the front of the knee joint. Moreover, in sections C and D a second layer of padding, identified as 220*a* and 220*b*, covers both sides of the proximal tibia 20 and a third layer, identified by the numerals 320*a* and 320*b*, adds additional thickness to the padding at the proximal tibia 20 adjacent to the patella 34.

In the padding, as described in relation to particularly FIG. 2, it is noted that the shape of the knee changes from the extending or standing position to a flexion or squatting position. The front of the knee actually becomes wider with increasing knee flexion. This changing shape of the knee allows for the spacing between the sections A, B, C and D to increase or decrease between the standing position to the squatting position of a wearer. Moreover, as the knee flexes, any material on the front side of the knee also increases in length and with the four sections A, B, C and D, the change in spacing therebetween accommodates the increased length of the knee, particularly in the front.

For increased protection along the lower part of the leg, padding identified as areas E and F are disposed on either side of the tibia (front leg bone 38). The first layer of padding in Section E is identified by the numeral 138*a* and the first layer of padding in Section F is identified by the numeral 138*b*. Additional layers of padding 237*a*, 237*b* adjacent proximal tibia padding 120*a*, 120*b* may also be provided for additional protection of the patella 34. Moreover, additional layers of padding 238*a*, 238*b* are provided for additional protection of the tibia 38.

The thickness of each layer of padding is usually from about 0.25 to 1.0 inches in thickness. Moreover, the center line "X" which separates padding areas A, B from C, D is at the center axis of rotation of the knee which is about 1.4 inches above the knee joint.

The spacings between areas A, B, C, D, and the padding 134 for the patella 34, as identified by the numerals 60, 61, 62, 63, 64 is usually from about 0.25 to 0.50 inches in a non-extended or flexed condition, as shown in FIG. 1. And, in an extended condition, as shown in FIG. 4, the spacing is usually from about 0.05 to 0.25 inches.

It will be realized that various changes may be made to the specific embodiment shown and described without departing from the principles and spirit of the present invention.

What is claimed is:

1. A knee protector comprising:

a leg sleeve having an upper opening for receiving a distal femur, and a lower opening for receiving a proximal tibia;

a plurality of pads positioned within said sleeve at selected positions to cover a patella, a lower portion of the distal femur, the femoral condyles, an upper end of the fibula and upper end of the proximal tibia with spacings between said plurality of pads to accommodate bending of a knee, said spacings defining a longitudinal break and a transverse break in said knee protector whereby the longitudinal break allows expansion of said knee protector upon knee flexion and the transverse break allows unimpeded knee flexion and extension.

2. The knee protector of claim 1 wherein said plurality of pads includes four pads with a spacing therebetween, said four pads including a first and a second pad positioned to cover opposed sides of the lower distal end of the femur and a third and fourth pad positioned on opposite sides of the upper end of the tibia.

3. The knee protector of claim 2 including a fifth pad positioned to cover the patella and the patella tendon and tibial tubercle, said fifth pad being spaced from said first, second, third and fourth pads.

4. The knee protector of claim 3 wherein said fifth pad is of tear-drop shape.

5. The knee protector of claim 2 wherein each of said pad sections includes a plurality of layers of padding including a first additional layer of padding positioned over the femoral condyles and a first and second additional layer of padding which follows the contour of the bony anatomy of the femoral condyles.

6. The knee protector of claim 2 wherein each of said four pads includes a plurality of layers of padding including a second additional layer of padding covers both sides of the proximal tibia with a second additional layer of padding at the proximal tibia adjacent the patella.

7. The knee protector of claim 2 including a fifth and sixth pad spacing from said third and fourth pads and disposed on opposed sides of the tibia.

8. A knee protector, comprising:

a sleeve having an upper opening, a lower opening, and a plurality of pads positioned within said sleeve at preselected positions in order to provide covering to a patella, a lower portion of a distal femur, a femoral condyles, an upper end of a fibula and upper end of a proximal tibia with spacings between said pads, said spacings defining a longitudinal break and a transverse break in said knee protector whereby the longitudinal break allows expansion of said knee protector upon knee flexion and the transverse break allows unimpeded knee flexion and extension.

9. A knee protector, comprising:

a sleeve having an upper opening, a lower opening, a first and a second pad positioned within said sleeve to cover opposed sides of the lower distal end of the femur and a third and fourth pad positioned on opposite sides of the upper end of the tibia with spacings between said first, second, third and fourth pads to accommodate bending of a knee, said spacings defining a longitudinal break and a transverse break in said knee protector whereby the longitudinal break allows expansion of said knee protector upon knee flexion and the transverse break allows unimpeded knee flexion and extension.

10. The knee of claim 9 including a fifth pad positioned to cover the patella and the patella tendon and tibial tubercle, said fifth pad being spaced from said first, second, third and fourth pads.

11. The knee protector of claim 10 wherein said fifth pad is of tear-drop shape.

12. The knee protector of claim 9 wherein each of said pad sections includes a plurality of layers of padding including a first additional layer of padding positioned over the femoral condyles and a first and second additional layer of padding which follows the contour of the bony anatomy of the femoral condyles.

13. The knee protector of claim 9 wherein each of said four pads includes a plurality of layers of padding including a second additional layer of padding covers both sides of the proximal tibia with a second additional layer of padding at the proximal tibia adjacent the patella.

14. The knee protector of claim 9 including a fifth and sixth pad spaced from said third and fourth pads and disposed on opposed sides of the tibia.

15. The knee protector of claim 2 wherein spacing between the pads covering the lower distal end of the femur and the upper end of the tibia area at the center axis of rotation of the knee joint.

16. The knee protector of claim 8 wherein spacing between the pads covering the lower distal end of the femur and the upper end of the tibia area at the center axis of rotation of the knee joint.

17. The knee protector of claim 9 wherein spacing between the pads covering the lower distal end of the femur and the upper end of the tibia are at the center axis of rotation of the knee joint.

* * * * *

UNITED STATES PATENT AND TRADEMARK OFFICE

CERTIFICATE OF CORRECTION

PATENT NO. : 7,114,189 B1
APPLICATION NO. : 10/955719
DATED : September 30, 2004
INVENTOR(S) : Kleinert It is certified that error appears in the above-identified patent and that said Letters Patent is hereby corrected as shown below:

Column 2, Line 42, delete “28a and”;

Column 3, Line 5, delete “28a and”;

Column 3, Line 7, delete “28a”;

Column 3, Line 8, delete “and”; and,

Column 3, Line 42, delete “60” and insert -- 65 -- in place thereof

Signed and Sealed this

Twenty-fifth Day of December, 2007

JON W. DUDAS
*Director of the United States Patent and Trademark Office*

UNITED STATES PATENT AND TRADEMARK OFFICE

CERTIFICATE OF CORRECTION

PATENT NO. : 7,114,189 B1
APPLICATION NO. : 10/955719
DATED : October 3, 2006
INVENTOR(S) : Kleinert It is certified that error appears in the above-identified patent and that said Letters Patent is hereby corrected as shown below:

Column 2, Line 42, delete “28a and”;

Column 3, Line 5, delete “28a and”;

Column 3, Line 7, delete “28a”;

Column 3, Line 8, delete “and”; and,

Column 3, Line 42, delete “60” and insert -- 65 -- in place thereof

This certificate supersedes the Certificate of Correction issued December 25, 2007.

Signed and Sealed this

Twenty-ninth Day of January, 2008

JON W. DUDAS
*Director of the United States Patent and Trademark Office*